US011668146B2

(12) United States Patent
Hutton

(10) Patent No.: US 11,668,146 B2
(45) Date of Patent: Jun. 6, 2023

(54) PISTON SHUT-OFF VALVE FOR ROTARY STEERABLE TOOL

(71) Applicant: REME, LLC, Conroe, TX (US)

(72) Inventor: Richard Hutton, Avon (GB)

(73) Assignee: Reme, LLC, Conroe, TX (US)

( * ) Notice: Subject to any disclaimer, the term of this patent is extended or adjusted under 35 U.S.C. 154(b) by 0 days.

(21) Appl. No.: 17/958,895

(22) Filed: Oct. 3, 2022

(65) Prior Publication Data

US 2023/0042012 A1 Feb. 9, 2023

(30) Foreign Application Priority Data

Aug. 3, 2021 (WO) ..... PCT/GB2021/052003

(51) Int. Cl.
*E21B 21/10* (2006.01)
*E21B 7/06* (2006.01)

(52) U.S. Cl.
CPC ..... *E21B 21/10* (2013.01); *E21B 7/06* (2013.01)

(58) Field of Classification Search
CPC ..... E21B 7/04; E21B 7/06; E21B 21/10
See application file for complete search history.

(56) References Cited

U.S. PATENT DOCUMENTS 5,520,255 A 5/1996 Barr et al.
5,553,678 A 9/1996 Barr et al.
5,706,905 A 1/1998 Barr
5,803,185 A 9/1998 Barr et al.
6,158,529 A 12/2000 Dorel
7,389,830 B2 6/2008 Turner et al.
7,413,034 B2 8/2008 Kirkhope et al.
8,469,104 B2 6/2013 Downton
8,869,916 B2 10/2014 Clausen et al.
9,145,736 B2 9/2015 Peter et al.
9,624,727 B1 4/2017 Hutton
10,683,702 B2 6/2020 Conger et al.
2012/0160564 A1 6/2012 Downton et al.
2014/0014413 A1 1/2014 Niina et al.
2015/0337598 A1 11/2015 Rushton et al.
2016/0002992 A1* 1/2016 Rushton ..... E21B 7/06 175/317

(Continued)

OTHER PUBLICATIONS

Ma, et al., Overview on vertical and directional drilling technologies for the exploration and exploitation of deep petroleum resources, Geomech. Geophys. Geo-energ. Geo-resour. (2016) 2:365-395.

*Primary Examiner* — Dany E Akakpo
(74) *Attorney, Agent, or Firm* — Patterson Intellectual Property Law, P.C.; William E. Sekyi

(57) ABSTRACT

A shut-off system and control method for a rotary steerable tool that includes a body having an inner chamber, a piston gallery extending between the inner chamber and a piston port, and an exhaust gallery extending between the inner chamber and an exhaust port. A spool in the inner chamber is movable into a plurality of positions to direct and control the flow of drilling fluid to energize pistons of the rotary steerable tool. The spool includes a spool shaft. A first passage extends through the spool shaft and receives drilling fluid via a spool inlet port in the shaft from a drilling fluid inlet port of the rotary steerable tool. A shut off valve is controlled to rotate on the spool shaft to open and shut the spool inlet port to drilling fluid flow.

17 Claims, 9 Drawing Sheets

(56) References Cited

U.S. PATENT DOCUMENTS

| | | | | |
|---|---|---|---|---|
| 2019/0249494 | A1 | 8/2019 | Winslow et al. | |
| 2020/0141188 | A1 | 5/2020 | Marshall et al. | |
| 2020/0325731 | A1* | 10/2020 | Chambers | E21B 7/06 |
| 2020/0392790 | A1 | 12/2020 | Perry et al. | |
| 2020/0392791 | A1 | 12/2020 | Nanayakkara et al. | |

* cited by examiner

PISTON SHUT-OFF VALVE FOR ROTARY STEERABLE TOOL

The present invention relates generally to a method and apparatus for controlling a rotary steerable tool for drilling a downhole formation having a piston shut-off valve. More particularly, but not exclusively, the present disclosure pertains to a fluid control valve with a piston shut-off and related method for enabling, disabling and controlling the steering and orientation in a rotary steerable tool for drilling subsurface formations as when drilling oil and gas wells.

BACKGROUND OF THE INVENTION

In the oil and gas exploration and extraction industries, forming a wellbore conventionally involves using a drill string to bore a hole into a subsurface formation or substrate. The drill string, which generally includes a drill bit attached at a lower end of tubular members, such as drill collars, drill pipe, and optionally drilling motors and other downhole drilling tools, can extend thousands of feet or meters from the surface to the bottom of the well where the drill bit rotates to penetrate the subsurface formation. At times, drillers have found it useful to control the direction of drilling to follow desired non vertical trajectories to drill through or reach target subsurface formations. Thus, directional drilling can be particularly desirable to reach pockets of oil-bearing rock or to direct the well-bore away from other nearby well-bores. Typically, directional drillers initially drill wells vertically, or nearly vertically, until reaching a desired kickoff point or well depth when the driller attempts to deflect the drill bit and rapidly change the direction of drilling to steer drilling in a desired trajectory. The rapid change in the direction of drilling, also known as dog leg, can be expressed in degrees per 100 feet of course length. Directional drillers have used various tools and techniques to kick off wells to achieve desired dog leg, and also to more generally steer the progress of the drill bit though subsurface formations. Early methods of directional drilling used a drilling motor with a bent housing located close to the drill bit. However this method could be problematic because for the periods of time when using such a motor to direct the wellbore, the drill string did not rotate, resulting in slow drilling speed and issues with transporting the drilling cutting back to the surface.

The industry subsequently developed rotary steerable drilling tools which allowed the drill string to be continually rotated when both steering in a direction or just drilling ahead. Most rotary steerable tools can be placed into two categories: point-the-bit and push-the-bit. Point-the-bit tools generally have a shaft on the lower end of the tool which is connected to a drill bit and by pointing the shaft in the intended drilling direction, similar to the method described above for mud motors but with the add advantage of always rotating the drill string. Push-the-bit tools generally have pistons attached to pads which push against the side of the well-bore to direct or guide the drill bit into the required direction.

There are two conventional methods of deploying the pistons on 'push-the-bit' tools. The first uses a closed-loop hydraulics system with items such as a pump, fluid control valves, pistons, and a fluid reservoir. These systems can be quite complex and expensive to build and maintain. The second method involves using the fluid within the drill string which is pumped from the drilling rig though the bottom hole assembly and out through the drill bit. By using this method, the hydraulic power required by the pistons is generated by large motors and pumps at the rig site rather than downhole. One disadvantage of using drilling mud is that it can contain abrasive elements such as sand which rapidly wear the rotary steerable tools. Another disadvantage is drilling mud can also include particles specifically added to block up small holes in the rock formations, and these particles can also cause blockages within the rotary steerable tools. Blockages in the passages, channels and fluid galleries within these tools can impair fluid flow into and out of the pistons and degrade rotary steerable tool performance.

Rotary steerable tools generally include valves known as fluid control valves to control the flow of drilling fluid or mud into the tools' pistons. Two methods can conventionally be used for controlling the actuation of pistons. In one method, a rotary steerable tool includes a valve that can be opened to actuate the piston by allowing the flow of fluid pumped through the drill string into the piston's chamber. After a period of time, the valve is closed to trap fluid in the chamber as the drilling tool continues to rotate. Although the valve remains closed, these tools included small fluid passages with bleed nozzles that allowed fluid to continually escape from the piston chamber back into the wellbore. As fluid continues to escape from the piston chamber through a bleed nozzle piston, the force on the pads pushes the piston back into its inner position and the fluid is forced out through a small bleed nozzle. This is a simple system of operation only requiring the fluid control valve to perform one function, which is to control the flow of fluid into the piston chamber. The downside of this solution though is that the bleed nozzle in the piston can become blocked with lost circulation material or foreign debris. Furthermore energy is consumed in forcing the piston back into its inner position which can result in a reduction of piston force for actual steering control. This then results in reducing achievable rotary steerable tool build rates, particularly at the higher drilling string rotational speeds.

An alternative solution has been to use fluid control valves which control both the flow of fluid into the piston and controls the flow of fluid back out of the piston. But even with these alternative solutions, the design of these fluid control valves still require restricting the exhaust flow of drilling fluid from the chamber of a de-energized piston. In addition, several of these alternative solutions are impractical as their designs are unable to accommodate the large pressure differentials between high and low pressure sides of their fluid control valve components and maintain effective fluid tight seals. Accordingly, these alternatives are still unable to achieve the desired high build rates that can beneficially provide drillers with additional flexibility. Furthermore, these alternatives have limited ability to adjust the relative timing, duration, and intensity of the activation and deactivation phases to control the performance profile according to specific wellbore needs.

What is needed, then, is an improved rotary steerable tool that can achieve the desired high build rates particularly at the higher drilling string rotational speeds that can beneficially provide drillers with desired performance flexibility. What is also needed is a rotary steerable tool in which the relative timing and duration of the activation and deactivation phases can be adjusted by altering downhole operation, or by simple replacement of components, to control the performance profile according to specific wellbore needs.

Another disadvantage of the fluid control valves currently in use is that they do not have the provision for switching off flow of drilling fluid off to the pistons to disable operation of the rotary steerable tool when steering control is not required. A rotary steerable, or similar, tool's pistons may only be required to operate half of the time. Unnecessarily actuating the pistons can result in additional wear on the pistons which can result in loss of steering control and premature end to the drilling run. Although some rotary steerable tools have attempted to utilize rotary disc valves to switch off the flow of fluid to the pistons when steering control is not required, actuation of these disc valves can be unreliable and they may frequently leak due to high wear, frequent component failures due to high stress and uneven loading of their disk elements. Thus, in many applications, these rotary disc valves do not provide an effective solution. What is needed, then, is an improved rotary steerable tool having a more reliably actuated, leak resistant system to controllably shut off drilling fluid flow to the rotary steerable tool pistons and disable operation of the rotary steerable tool, or to open the flow of drilling fluid to the pistons to enable operation of the rotary steerable tool and steer drill string when desired.

BRIEF SUMMARY OF THE INVENTION

The present invention provides various embodiments that can address and improve upon some of the deficiencies of the prior art. For example, one embodiment provides a rotary steerable tool shut-off system which includes a fluid control valve body having an inner chamber with cylindrical side walls, a piston gallery extending between the inner chamber and a piston port, and an exhaust gallery extending between the inner chamber and an exhaust port, the inner chamber having a drilling fluid inlet port. A spool in the inner chamber includes a spool shaft that extends, from a transverse flange, longitudinally along a central axis of the inner chamber. A first passage extends longitudinally through at least a portion of the spool shaft. At least one spool inlet port in the spool shaft provides fluid communication between an outer surface of the spool shaft and the first passage. The first passage in the spool can be in fluid communication with the drilling fluid inlet port but not the exhaust port, and a second passage in the spool can be in fluid communication with the exhaust port but not the drilling fluid inlet port. The rotary steerable tool shut off system further includes a piston shut off valve that is rotatably mounted on the spool shaft. The piston shut off valve includes a shut off valve port which provides fluid communication between the inner chamber and the outer surface of the spool shaft. The piston shut off valve can rotate to a first position relative to the spool shaft such that the shut off valve port at least partially overlaps with the spool inlet port to provide fluid communication between the first passage and the drilling fluid inlet port. The shut off valve can also rotate to a second position relative to the spool shaft such that the shut off valve port does not overlap with the spool inlet port and seals the first passage from fluid communication with the drilling fluid inlet port.

According to one aspect, this embodiment can further include a friction plate rotatably mounted on the spool shaft and fixedly connected to the inner chamber, wherein the friction plate is slidably coupled to the piston shut off valve. Optionally, a surface of the friction plate slidably engages a surface of the piston shut off valve. In an alternative option according to this aspect, at least one friction disk is rotatably mounted on the spool shaft, sandwiched between the friction plate and piston shut off valve, and at least one surface of the friction disk is slidably engaged with a surface of the piston shut off valve, the friction plate or a second friction disk.

According to another aspect of this embodiment, the spool shaft can extend through a bore of the shut off valve. In addition, a member of the spool shaft can engage with a member of the shut off valve to restrict the rotation of the shut off valve relative to the spool shaft between the first position and the second position.

According to yet another aspect, the spool is movable to an actuation position in the inner chamber such that the first passage forms a fluid flow path between the piston gallery and the drilling inlet port, and also movable to a discharge position such that the second passage forms a fluid flow path between the piston gallery and the exhaust port.

The exhaust gallery can have a flow path that is unrestricted. In one aspect, the first passage has a length and a first passage minimum flow cross sectional area at some point along its length, the second passage has a length and a second passage minimum flow cross sectional area at some point along its length, and the exhaust gallery has a length and an exhaust gallery minimum flow cross sectional area. The exhaust gallery minimum flow cross sectional area and the second passage minimum flow cross sectional area are preferably greater than at least half of the first passage minimum flow cross sectional area.

A still further embodiment provides a method of controlling a rotary steerable tool shut off system which includes providing a fluid control valve body having an inner chamber, a piston gallery extending between the inner chamber and a piston port, and an exhaust gallery extending between the inner chamber and an exhaust port, the inner chamber having a drilling fluid inlet port. The method also includes providing a spool in the inner chamber, the spool having a spool shaft extending longitudinally along a central of the inner chamber from a transverse flange, a first passage that extends longitudinally through at least a portion of the spool shaft, and at least one spool inlet port providing fluid communication between an outer surface of the spool shaft and the first passage. The first passage can be in fluid communication with the drilling fluid inlet port but not the exhaust port, and a second passage in the spool is configured to be in fluid communication with the exhaust port but not the drilling fluid inlet port. The method further includes providing a piston shut off valve rotatably mounted on the spool shaft, wherein the piston shut off valve includes a shut off valve port which provides fluid communication between the inner chamber and the outer surface of the spool shaft.

According to one aspect, the method can include rotating the piston shut off valve to a first position relative to the spool shaft such that the shut off valve port at least partially overlaps with the spool inlet port to provide fluid communication between the first passage and the drilling fluid inlet port. Optionally, the method can also include rotating the piston shut off valve to a second position relative to the spool shaft such that the spool inlet port does not overlap with the spool inlet port and seals the first passage from fluid communication with the drilling fluid inlet port.

According to another aspect, the method can further include providing a friction plate rotatably mounted on the spool shaft and fixedly connected to the inner chamber, wherein the friction plate is slidably coupled to the piston shut off valve. Optionally, a surface of the friction plate slidably engages a surface of the piston shut off valve. As a further option, the method can further include providing at least one friction disk rotatably mounted on the spool shaft sandwiched between the friction plate and piston shut off valve, wherein at least one surface of the friction disk is slidably engaged with a surface of the piston shut off valve, the friction plate or a second friction disk. The method can alternatively include rotating the spool counter-clockwise relative to the inner chamber; and rotating the piston shut off valve to a first position relative to the spool shaft such that the shut off valve port at least partially overlaps with the spool inlet port to provide fluid communication between the first passage and the drilling fluid inlet port.

According to yet another aspect, the method can include receiving fluid from the fluid inlet port into the first passage and discharging the fluid into the piston gallery when the spool is in an actuation position, receiving fluid from the piston gallery into the second passage, and discharging the fluid into the exhaust gallery when the spool is in a discharge position.

The method can also include rotating the spool clockwise relative to the inner chamber; and rotating the piston shut off valve to a second position relative to the spool shaft such that the spool inlet port does not overlap with the spool inlet port and seals the first passage from fluid communication with the drilling fluid inlet port.

DETAILED DESCRIPTION OF THE INVENTION

Figure 1:
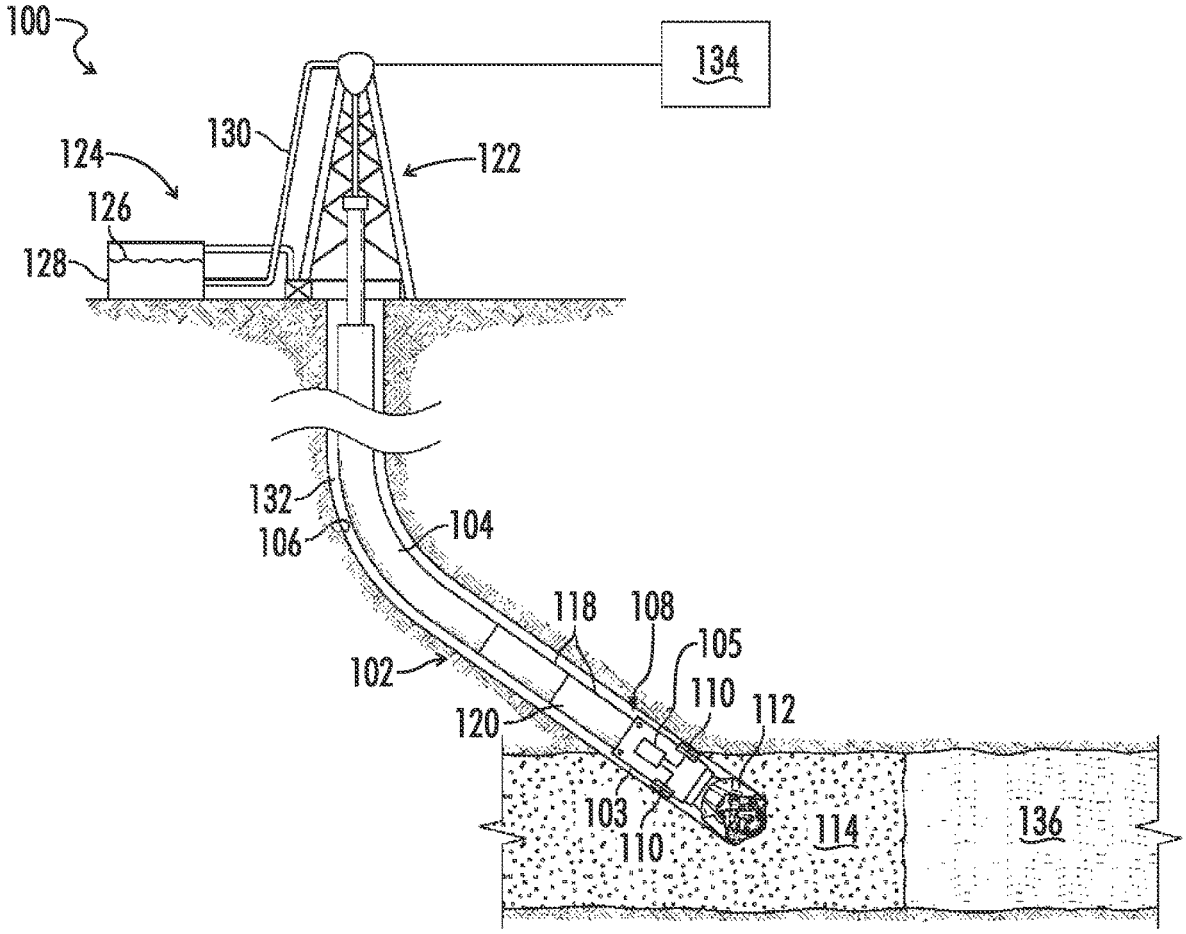
FIG. 1 is a schematic view of a drilling system according to an embodiment of the present invention.

Referring generally to FIG. 1, drilling systems such as drilling system 100 can utilize rotary steerable tools with fluid control valves to steer a drill as it bores through a subsurface formation. FIG. 1 illustrates an embodiment of the drilling system 100 as having a bottom hole assembly 102 which is part of a drill string 104 used to form a desired, directionally drilled wellbore 106. The illustrated drilling system 100 comprises a rotary steerable tool 108 that includes a steering body. The steering body includes at least one laterally movable steering pad 110 and is connected to a tool control system 105. Tool control system 105 controls an actuating piston in the steering body which is connected to steering pad 110. Under control of the tool control system 105, the actuating piston can extend to actuate steering pad 110. The tool control system 105 can include a fluid control valve and an electronic control unit. By way of example, the one or more steering pads 110 may be designed to act against a corresponding pivotable component of the rotary steerable tool 108 or against the surrounding wellbore wall to provide directional control. In this particular embodiment, the tool control system 105 is housed within a drill collar 103 of the rotary steerable tool 108. The drill collar 103 and the steering body, which together form the rotary steerable tool 108, are coupled with a drill bit 112 which is rotated to cut through a surrounding rock formation 114 which may be in a hydrocarbon bearing reservoir 136.

Depending on the environment and the operational parameters of the drilling operation, drilling system 100 may comprise a variety of other features. For example, drill string 104 may include additional drill collars 118 which, in turn, may be designed to incorporate desired drilling modules, e.g. logging-while-drilling and/or measurement-while-drilling modules 120. In some applications, stabilizers may be used along the drill string to stabilize the drill string with respect to the surrounding wellbore wall.

Various surface systems also may form a part of the drilling system 100. In the example illustrated, a drilling rig 122 is positioned above the wellbore 106 and a drilling fluid system 124, e.g. drilling mud system, is used in cooperation with the drilling rig 122. For example, the drilling fluid system 124 may be positioned to deliver a drilling fluid 126 from a drilling fluid tank 128. The drilling fluid 126 is pumped through appropriate tubing 130 and delivered down through drilling rig 122 and through a central cavity or bore of drill string 104. In many applications, the return flow of drilling fluid flows back up to the surface through an annulus 132 between the drill string 104 and the surrounding wellbore wall. The return flow may be used to remove drill cuttings resulting from operation of drill bit 114. The drilling fluid 126 also may be used as an actuating fluid to control operation of the rotary steerable tool 108 and its movable steering pad or pads 110. In this latter embodiment, flow of the drilling/actuating fluid 126 to steering pads 110 is controlled by tool control system 105 in a manner which enables control over the direction of drilling during formation of wellbore 106.

The drilling system 100 also may comprise many other components, such as a surface control system 134. The surface control system 134 can be used to communicate with rotary steerable tool 108. In some embodiments, the surface control system 134 receives data from downhole sensor systems and also communicates commands to the rotary steerable tool 108 to control actuation of tool control system 105 and thus the direction of drilling during formation of wellbore 106. In other applications, as discussed in greater detail below, control electronics are located downhole in the rotary steerable tool 108 and the control electronics cooperate with an orientation sensor to control the direction of drilling. However, the downhole, control electronics may be designed to communicate with surface control system 134, to receive directional commands, and/or to relay drilling related information to the surface control system.

Figure 2:
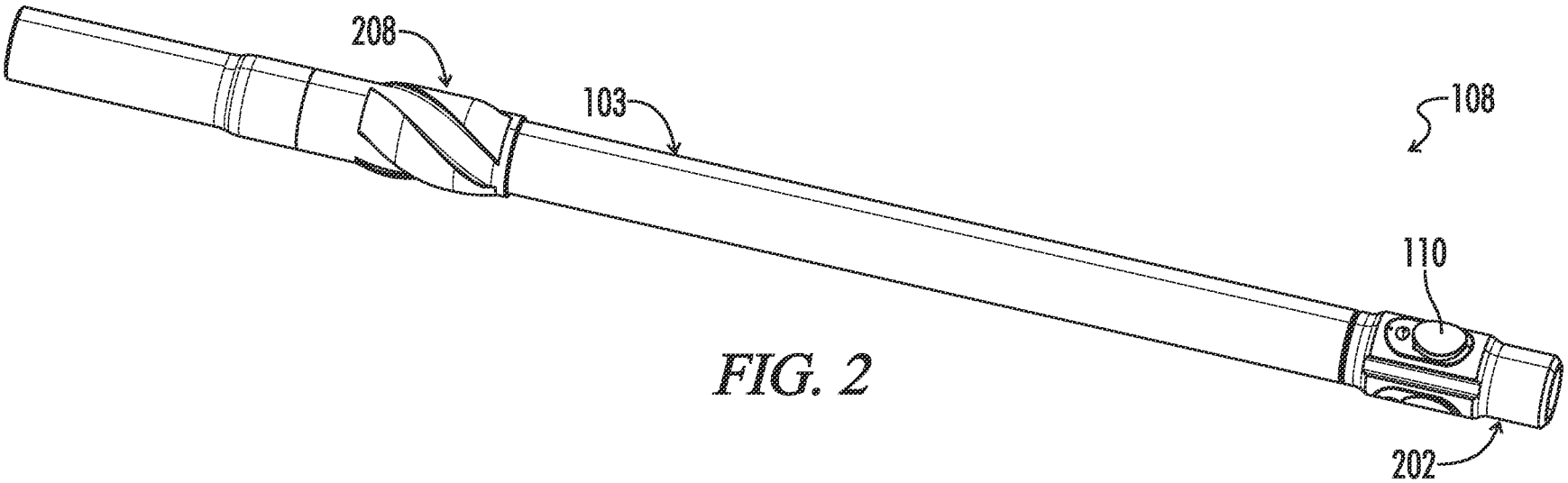
FIG. 2 is a perspective view of a rotary steerable tool according to an embodiment of the present invention.

FIG. 2 illustrates the rotary steerable tool 108 that includes steering body 202 with steering pad 110, drill collar 103 and stabilizer 208. The steering body 202 includes at least one piston connected to its associated steering pad 110. In this embodiment, steering body 202 includes three pistons and associated pads. The pistons are designed to extend from an inner to outer position, pushing its associated pad into press against the side of the wellbore to push the tool in the opposite direction.

The collar 206 is a typical drilling tool collar with a central passageway to allow for the flow of fluid from the drilling rig to pass through and also to house an electronic control unit.

Figure 3:
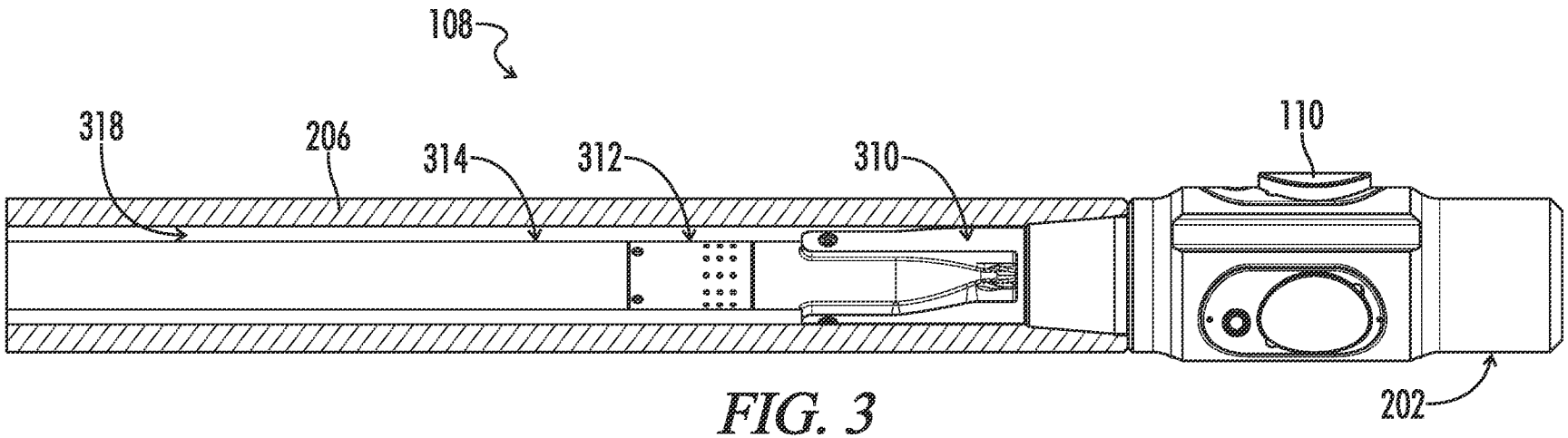
FIG. 3 is an elevational view of a steering body and a partial cut away elevational view of a collar according to an embodiment of the present invention.

FIG. 3 shows a side view of steering body 202 and a partial cut away view of the collar 103 which together form a rotary steerable tool. Although this figure shows the collar 206 as connected to steering body 202 to form a rotary steerable tool, collar 103 can, in other embodiments, be connected to other devices that can benefit from the functions of the tool control system 105, as an alternative to steering body 202. In the cut away view, the exterior wall of the rotary steerable tool collar 206 is cut away to show the central cavity 318 of the collar 103. The cavity 318 is an extension of, and is in fluid communication with, the uphole portions of the bore of the drill string 104. Therefore, drilling fluid 126 under pressure from the rig pumps flows through the rotary steerable tool cavity 318. As FIG. 3 also shows, electronic control unit 314, filter body 312 and fluid control valve 310 are located inside the rotary steerable tool collar 206. The fluid control valve 310 is an assembly of numerous components that will be described in more detail in FIG. 5. These components, alternatively, can collectively be referenced as fluid control valve assembly. The fluid control valve 310 attaches to the steering body 202, for example via a pin connection on the steering body 202, and diverts a proportion of drilling fluid via piston galleries in the fluid control valve 310 into flow galleries in steering body 202. These fluid galleries in steering body 202 are connected to steering body pistons that can extend under the pressure of the drilling fluid to actuate steering pads 110. The filter body 312 contains a filter screen that has a series of small holes through which some of the pumped drilling fluid 126 flows so that only filtered drilling fluid 126 enters the fluid control valve 310. Central cavity 318 also houses an electronics control unit 316 which is encased in a pressure barrel. In some embodiments, the electronics control unit 316 can measure the wellbore position and calculate the required steering direction. The electronics control unit 316 can also include a motor that actuates a spool of the fluid control valve 310.

Figure 4:
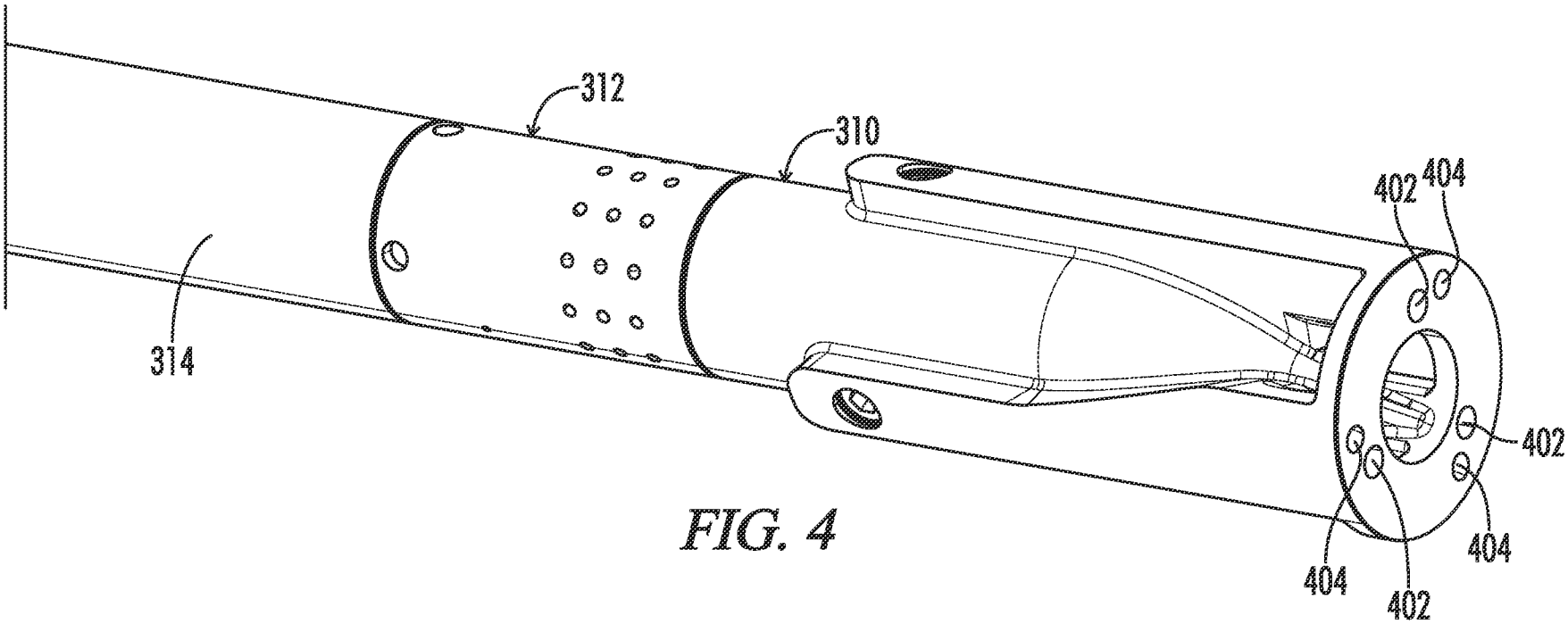
FIG. 4 is a partial perspective view of a tool control system according to an embodiment of the present invention.

FIG. 4 is a partial perspective view of the tool control system 105 showing the external surface and lower end of the fluid control valve 310, the filter body 312, and a partial view of the electronics control unit 316. Filter body 312 receives a proportion of the drilling fluid which is pumped from the rig and which is diverted into the fluid control valve through the filter body 312. The filter body 312 screens out large particulates from all drilling fluid 126 that enters fluid control valve 310. Fluid control valve 310 selectively directs drilling fluid 126 pumped from the rig through piston gallery outlet ports 404 and into fluid galleries of the steering body 202 to energize steering body pistons and actuate one or more steering pads 110. Drilling fluid 126 returning from a deenergizing piston, exits the fluid control valve 310 via exhaust gallery outlet ports 402 and the end of the exhaust galleries, and onwards to the low-pressure zone outside of the rotary steerable tool 108 which is commonly known as the annulus.

Figure 5:
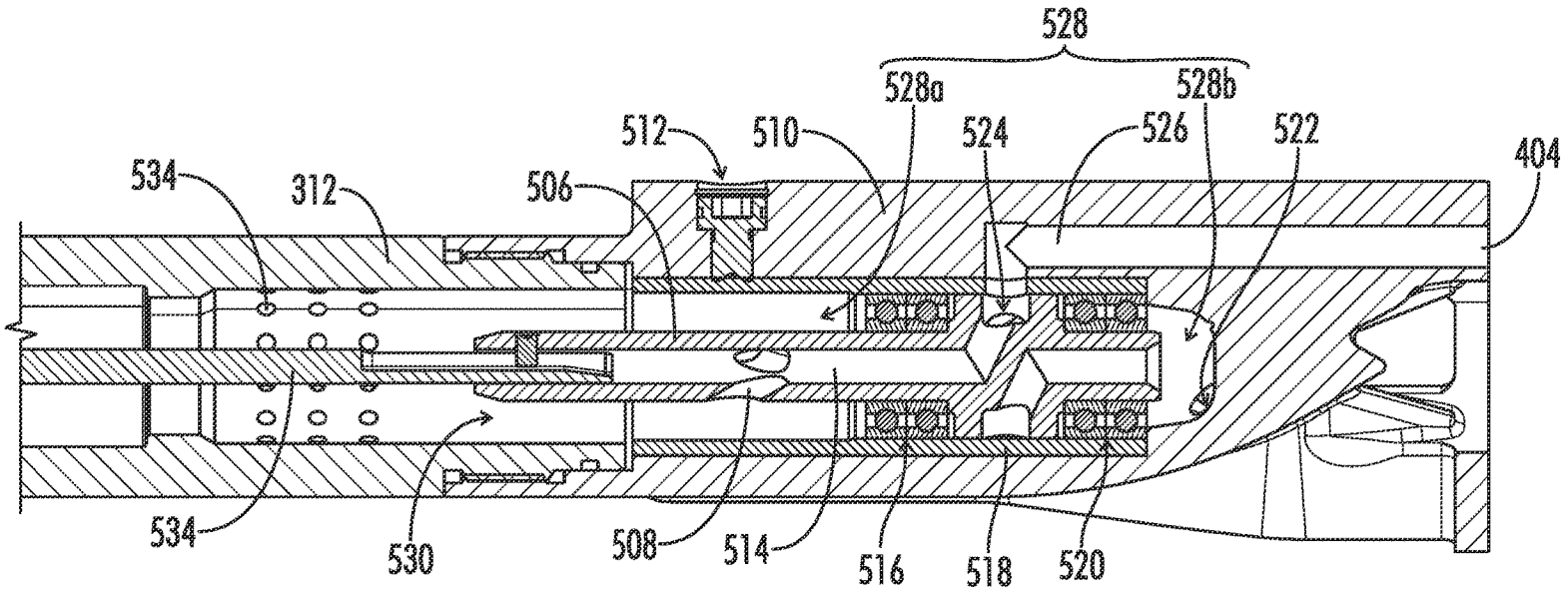
FIG. 5 is a cross sectional view of a filter body and fluid control valve of a tool control system according to an embodiment of the present invention with a spool positioned to energize a piston.

FIG. 5 is a cross sectional view through the filter body 312 and the fluid control valve 310 of the tool control system 105. The fluid control valve 310 is an assembly of components including a fluid control valve body 510 having an inner chamber 528 which is a central cavity in the body into which drilling fluid 126 can flow. Preferably, the inner chamber 528 can be a cavity with cylindrical side walls formed by the fluid control valve body 510, with a longitudinal central axis that is coaxial with the longitudinal axis of collar 206 and the rotary steerable tool 108. The inner chamber 528 extends to and has an opening at an uphole end of the fluid control valve body 510, identified as drilling fluid inlet port 530, where filter body 312 can be attached and through which filtered drilling fluid 126 can flow into an uphole chamber portion 528*a* of inner chamber 528. At least one a piston gallery 526 extends from inner chamber 528 to an exterior surface of the fluid control valve body 510 where it forms a piston gallery outlet port 404. Piston gallery 526 is a hollow passage through which drilling fluid 126 can flow between inner chamber 528 and galleries or passages in an attached actuating device, such as a steering body 202. In the case of an attached steering body 202, piston gallery 526 provides fluid communication between inner chamber 528 and the actuating pistons of the steering body 202 via galleries in the steering body 202. At least one exhaust gallery 522 extends from a downhole chamber portion 528*b* of inner chamber 528 to an exterior surface of the fluid control valve body 510 where it forms an exhaust gallery outlet port 402. Exhaust gallery 522 is a hollow passage through which drilling fluid 126 can flow out of the downhole chamber portion 528*b* of inner chamber 528 and ultimately into the annulus.

Figure 6:
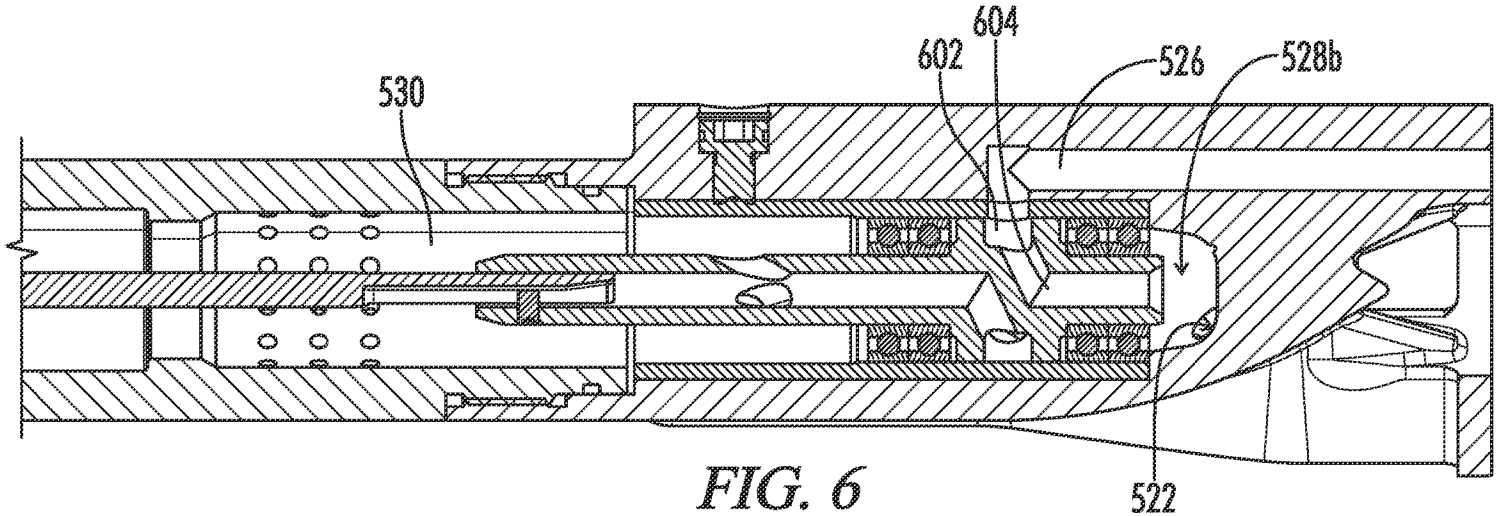
FIG. 6 is an alternate cross sectional view of a filter body and fluid control valve of a tool control system according to an embodiment of the present invention with a spool positioned to de-energize a piston.

Fluid control valve 310 includes a valve member or spool 506 that has a first passage 514 through which fluid can flow between spool inlet ports 508 and first passage outlet 524, and a second passage 602 through which fluid can flow between second passage inlet 604 and downhole chamber portion 528*b* of inner chamber 528 (as shown in FIG. 6). Spool 506 is located within the inner chamber 528 and can be moved into various positions to control the flow of drilling fluid 126 from the drilling fluid inlet port 530 to each of the piston galleries 526 and to control the flow of drilling fluid 126 from each of the piston galleries 526 via the inner chamber 528 to the exhaust galleries 522. Spool 506 also isolates and maintains a fluid seal between the uphole chamber portion 528*a* and the downhole chamber portion 528*b*, preventing drilling fluid 126 in the uphole chamber portion 528*a* from directly communicating with or flowing into the downhole chamber portion 528*b* and escaping through any exhaust galleries. To isolate the uphole chamber portion 528*a* from downhole chamber portion 528*b*, spool 506 preferably extends across the entire cavity to seal against the periphery of the wall of inner chamber 528. According to some embodiments, the seal can be formed by tight tolerances between the spool and the periphery of the wall of inner chamber 528. With these tight tolerances, the gap between the spool and the periphery of the wall inner chamber 528 should be small enough to reduce leakage of drilling fluid from high fluid pressure areas in the uphole chamber portion 528*a* to low pressure areas in the downhole chamber portion 528*b* so that the adequate pressure differentials can be maintained between the chambers. According to other embodiments, instead of or in addition to relying on tight tolerances to form a seal, spool 506 can use any type of suitable sealing element to extend in the gap between spool 506 and the periphery of the wall of inner chamber 528 to form an effective, durable seal while minimizing friction between the spool 506 and the wall of inner chamber 528.

When spool 506 is positioned so that first passage outlet 524 aligns with at least a portion the opening of a piston gallery 526, the spool provides a flow path between uphole chamber portion 528*a* and the aligned piston gallery. In this position, the spool can receive drilling fluid 126 from drilling fluid inlet port 530 into the first passage 514 through spool inlet ports 508 which can flow to first passage outlet 524 and into piston gallery 526. Thus, in this position, although the first passage 514 is in fluid communication with the uphole chamber portion 528*a* and the drilling fluid inlet 530, the first passage 514 remains isolated from the downhole chamber portion 528*b* and exhaust gallery 522.

When spool 506 is positioned so that second passage inlet 604 aligns with at least a portion of the opening of a piston gallery 526, (as shown in FIG. 6) spool 506 provides a flow path between the aligned piston gallery 526 and the downhole chamber portion 528*b*. In this position, fluid in piston gallery 526 can flow through second passage 602 into the downhole chamber portion 528*b* and exit fluid control valve 310 through exhaust gallery 522. Thus, in this position, although the second passage 602 is in fluid communication with the downhole chamber portion 528*b* and the exhaust gallery 522, the second passage 602 remains isolated from the uphole chamber portion 528*a* and drilling fluid inlet port 530.

The positioning of the first passage outlet 524, second passage inlet 604, and piston gallery opening at the wall of the inner chamber 528, can determine the positions in which spool 506 provides a flow path between an aligned piston gallery 526 and either the drilling fluid inlet. The size and shape of the first passage outlet 524, second passage inlet 604 and piston gallery opening at the wall of the inner chamber 528 can determine the magnitude of the flow path at various positions of spool 506 and the ease with which drilling fluid 126 can flow into a piston from the drilling fluid inlet port 530 and through first passage 514 or flow out of a piston to the annulus via second passage 602, downhole chamber portion 528*b* and exhaust gallery 522.

A suitable motor can actuate the spool 506 and move it from one position to another depending on the positions of the outlets of the piston galleries 526 and the positions of the first passage outlet 524 and second passage inlet 604 by, for example, a rotational motion around a central longitudinal axis of the inner chamber and coaxially with the longitudinal axis of the rotary steerable tool, or by a longitudinal translational movement within the inner chamber. For example, if the openings of one or more piston galleries are distributed radially around the wall of the inner chamber 528 at a common position along the inner chamber's central axis that coincides with the positions of first passage outlet and second passage outlet, as shown in FIGS. 5 and 6, the motor can rotate spool 506 around the inner chamber's central axis so that the first passage outlet and second passage outlet alternately align with the outlets of the piston galleries. For example, the motor can, be an electrical motor housed in electronic control unit 314 that can be coupled via drive shaft 534 to rotate spool 506 around a central longitudinal axis of the rotary steerable tool 108. With such rotational actuation of the spool 506, controlling the speed of rotation and appropriately selecting the size, shape, and angular positioning of the first passage outlet 524 and the second passage inlet, 604, the fluid control valve 310 can control the timing and duration of piston extension and retraction enabling the rotary steerable tool to adjust tool performance to better achieve rotary steerable tool dogleg and desired rates of rotation based on different wellbore conditions. To facilitate low friction rotation while maintaining an effective fluid seal and also facilitating replacement and maintenance of spool 506, spool 506 can optionally be mounted in inner chamber 528 on bearings 516, 520 within sleeve 518. This arrangement can provide for more tightly controlling clearance and minimizing fluid to leak between spool 506, bearings 516, 520 and sleeve 518.

Figure 7:
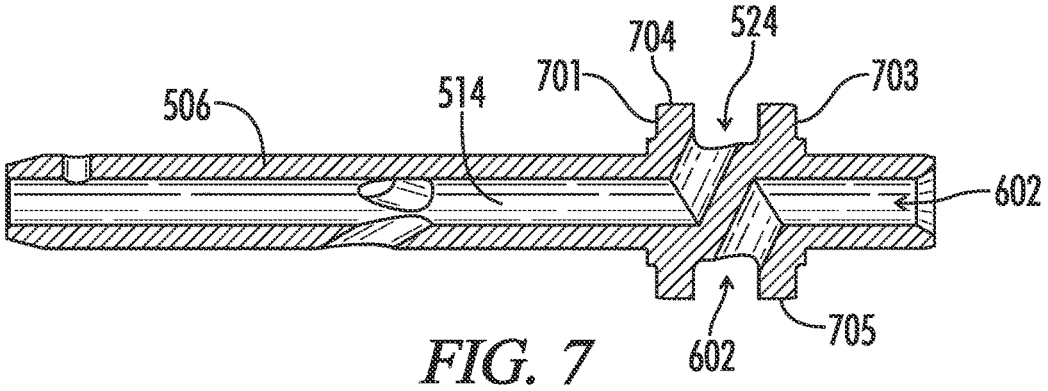
FIG. 7 is a cross sectional view of a spool according to one embodiment of the present invention.
Figure 8:
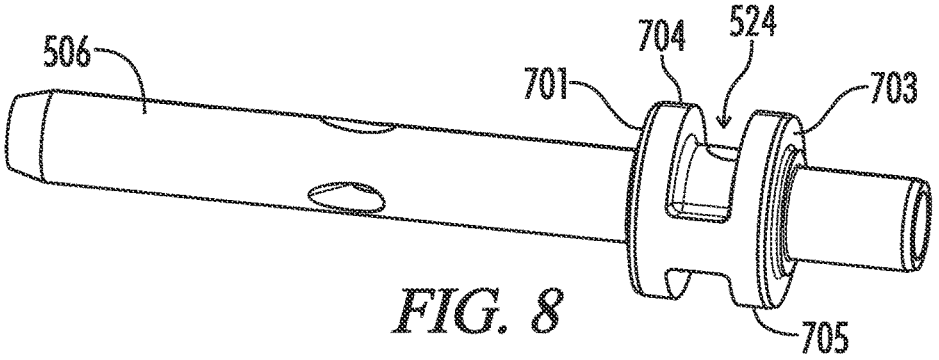
FIG. 8 is a perspective view of the embodiment of a spool according to FIG. 7.

As shown more clearly in FIGS. 7 and 8, in some embodiments, such as the embodiments shown in FIGS. 5 and 6, spool 506 of fluid control valve 310 can include a first passage 514 through which high pressure drilling fluid 126 from the uphole chamber portion 528*a* can enter and flow before exiting through the first passage outlet 524 and into piston gallery 526. Spool 506 can further include a lower wall or flange 705 which extends to the periphery of the wall of inner chamber 528 and around spool 506 and helps to seal high pressure drilling fluid 126 flowing through first passage outlet 524 from low pressure drilling fluid 126 in the downhole chamber portion 528*b*. Lower flange 705 therefore includes a low-pressure side 703 which can be exposed to low fluid pressure during operation. Spool 506 can also include an upper wall or flange 704 which extends to the periphery of the wall of inner chamber 528 and around spool 506 and helps to seal high pressure drilling fluid 126 flowing through first passage outlet 524 from high pressure drilling fluid 126 in the uphole chamber portion 528*a*. Lower flange 705 therefore include a high-pressure side 701 which can be exposed to high fluid pressure during operation. However, generally in operation, the pressure difference between fluid adjacent high pressure side 701 and fluid in or adjacent first passage outlet 524 is negligible compared to the pressure difference between fluid adjacent low-pressure side 703 and fluid adjacent in first passage outlet 524. The larger pressure differentials between low-pressure side 703 and first passage outlet 524 can potentially cause much more severe fluid leakage and pressure loss across lower flange 705 compared to the fluid leakage that the fluid pressure differential between high-pressure side 701 and first passage outlet 524 causes across upper flange 704. Thus, in the areas surrounding the first passage outlet 524, efficient operation of fluid control valve 310 can require flange 705 to provide a more effective and stronger seal than flange 704.

In addition, fluid control valve 310 can include a second passage inlet 604 and a second passage 602 through which low pressure drilling fluid 126 can exhaust from piston gallery 526 through downhole chamber portion 528*b*. To isolate and seal the flow of fluid in and adjacent to second passage inlet 604, upper wall or flange 704 helps to seal high pressure drilling fluid 126 in uphole chamber portion 528*a* from leaking into low pressure drilling fluid 126 in and adjacent to the second passage inlet 604. Similarly, to isolate and seal the flow of fluid in and adjacent to second passage inlet 604, lower wall or flange 705 helps to seal drilling fluid 126 flowing in and adjacent second passage inlet 604 from leaking into downhole chamber portion 528*b*. However, generally in operation, the pressure difference between fluid adjacent high pressure side 701 and fluid in or adjacent second passage inlet 604 is much more significant and greater compared to the pressure difference between fluid adjacent low-pressure side 703 and fluid adjacent in first passage outlet 604. The larger pressure differentials between high-pressure side 701 and second passage inlet 604 can potentially cause much more severe fluid leakage and pressure loss across upper flange 704 compared to the fluid leakage that the fluid pressure differential between low-pressure side 703 and second passage inlet 604 causes across lower flange 705. Thus, in the areas surrounding the second passage inlet 604, efficient operation of fluid control valve 310 can require flange 704 to provide a more effective and stronger seal than flange 705.

Figure 9:
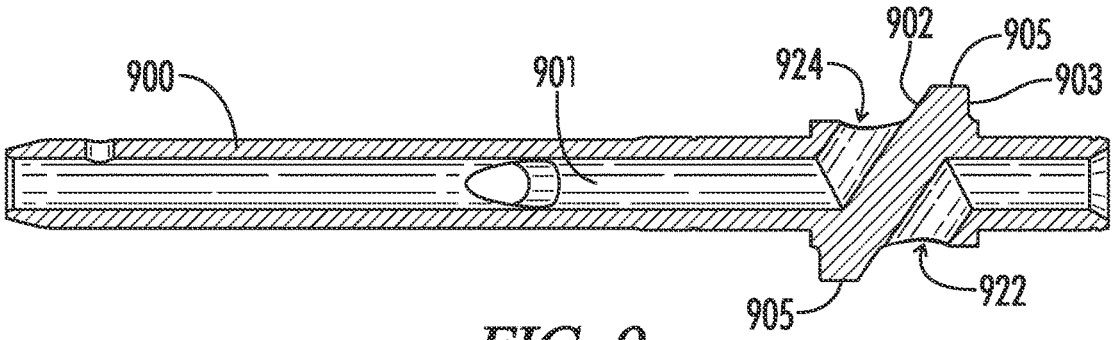
FIG. 9 is a cross sectional view of a spool according to an alternate embodiment of the present invention.
Figure 10:
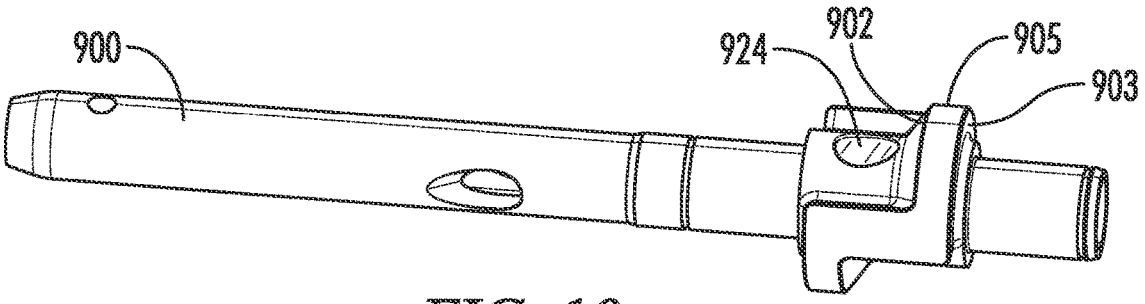
FIG. 10 is a perspective view of a spool according to FIG. 9.

A fluid control valve according to an alternative embodiment of a fluid control valve 310 can include an alternate spool 900, shown in FIGS. 9 and 10. Spool 900 can also include a first passage 901 and a first passage outlet 924, through which high pressure drilling fluid 126 from the uphole chamber portion 528*a* can enter and flow before exiting through the first passage outlet 924 and into piston gallery 526. In addition, spool 900 can also include a second passage and a second passage inlet 922 through which fluid can exit and exhaust from piston gallery 526 into downhole chamber portion 528*b*. However, as will be explained further below, because of the low pressure differentials that generally exist in normal operation in drilling fluid 126 between fluid in uphole chamber portion 528*a* and first passage outlet 924 can be negligible, spool 900 does not require an upper flange that extends to the periphery of the wall of inner chamber 528 to provide a seal between uphole chamber portion 528*a* and first passage outlet 924. Similarly, because of the low pressure differentials that generally exist in normal operation in drilling fluid 126 between fluid in downhole chamber portion 528*b* and second passage inlet 922 can be negligible, spool 900 does not require a lower flange that extends to the periphery of the wall of inner chamber 528 to provide a seal between downhole chamber portion 528*b* and second passage inlet 922. By avoiding the use of upper and lower flanges in areas where sufficient sealing can be provided by other means, drag and friction between spool 900 and the wall of inner chamber 528 can be reduced, facilitating easy rotation and movement of spool within the inner chamber 528 especially in the instances where drilling mud 126 contains high levels of loss circulation material. However, as can be seen in FIGS. 9 and 10, spool 900 includes a serpentine flange 905 that extends to the periphery of the wall of inner chamber 528 to provide a seal between downhole chamber portion 528*b* and second passage inlet 922, provide a seal between uphole chamber portion 528*a* and first passage outlet 924 and, in addition, provides a seal between the second passage inlet 922, which can contain fluid at low pressure, and first passage outlet 924, which can contain fluid at high pressure, during normal tool operation.

Figure 11:
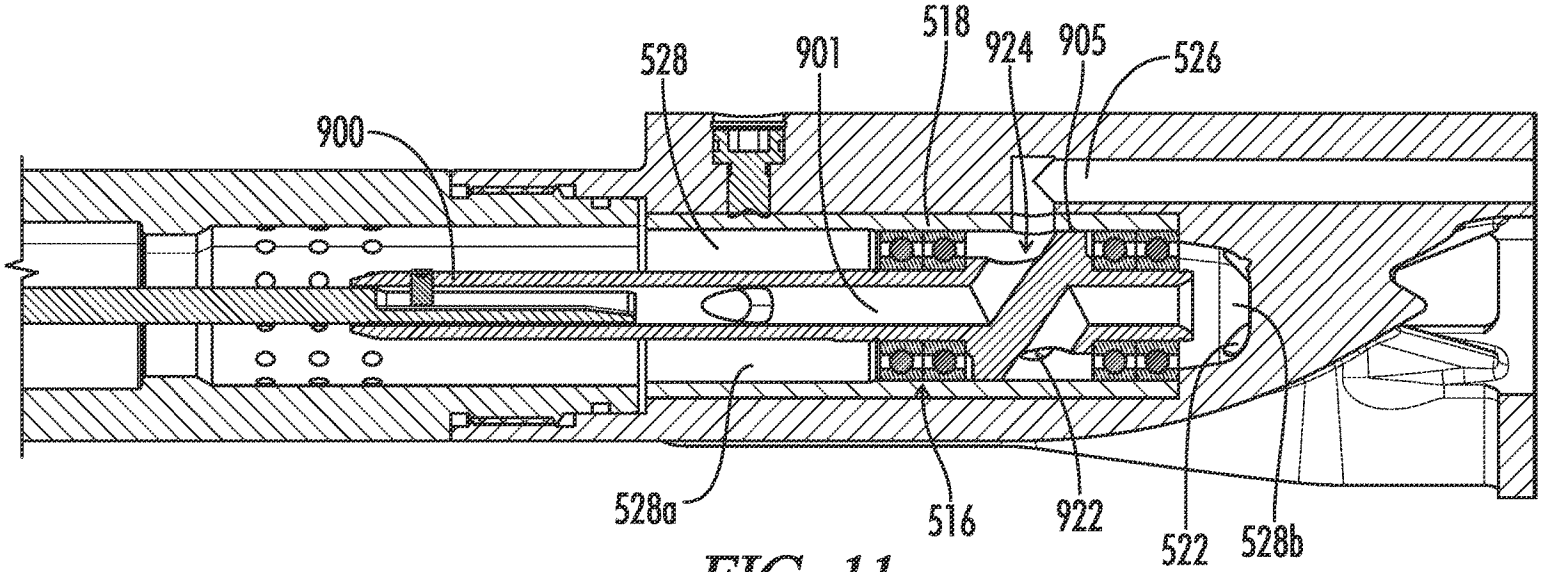
FIG. 11 is a cross sectional view of a fluid control valve of a tool control system incorporating a spool according to FIG. 9 in an alternate embodiment of the present invention with the spool positioned to energize a piston.

FIG. 11 shows alternative valve spool 900 installed in fluid control valve 301 in a first position to admit drilling fluid 126 in uphole chamber portion 528*a* through first passage 901, first passage outlet 924, and into piston gallery 525, and thereby energize a piston. Valve spool 900 can be movably mounted in fluid control valve 301 on a low friction a journal, bushing, or bearing, such as bearings 516 and 520, optionally within sleeve 518, to lower friction and the resistance of moving spool 900 as desired to control the flow of drilling fluid 126. Although no upper wall or flange separates uphole chamber portion 528*a* from first passage outlet 924, or lower chamber portion 528*b* from second passage inlet 922, bearings 516 and 520 should preferably be selected to provide a partial barrier to the flow of fluid between uphole chamber portion 528*a* from first passage outlet 924, and downhole chamber portion 528*b* from second passage inlet 922, and thereby provide sufficient sealing. Although some fluid may leak through the bearings 516, 520 the bearings should be selected to provide acceptably low leakage given the negligible pressure drop that should generally exist between uphole chamber portion 528*a* and first passage outlet 924, as well as between and downhole chamber portion 528*b* and second passage inlet 922, in normal tool operation. Meanwhile, serpentine flange 905 should be designed with close tolerances or appropriate seals against the periphery of the wall of inner chamber 528 to provide a sufficiently fluid tight seal, as previously described, between uphole chamber portion 528*a* and downhole chamber portion 528*b*, and also between second passage inlet 922 and first passage outlet 924.

Figure 12:
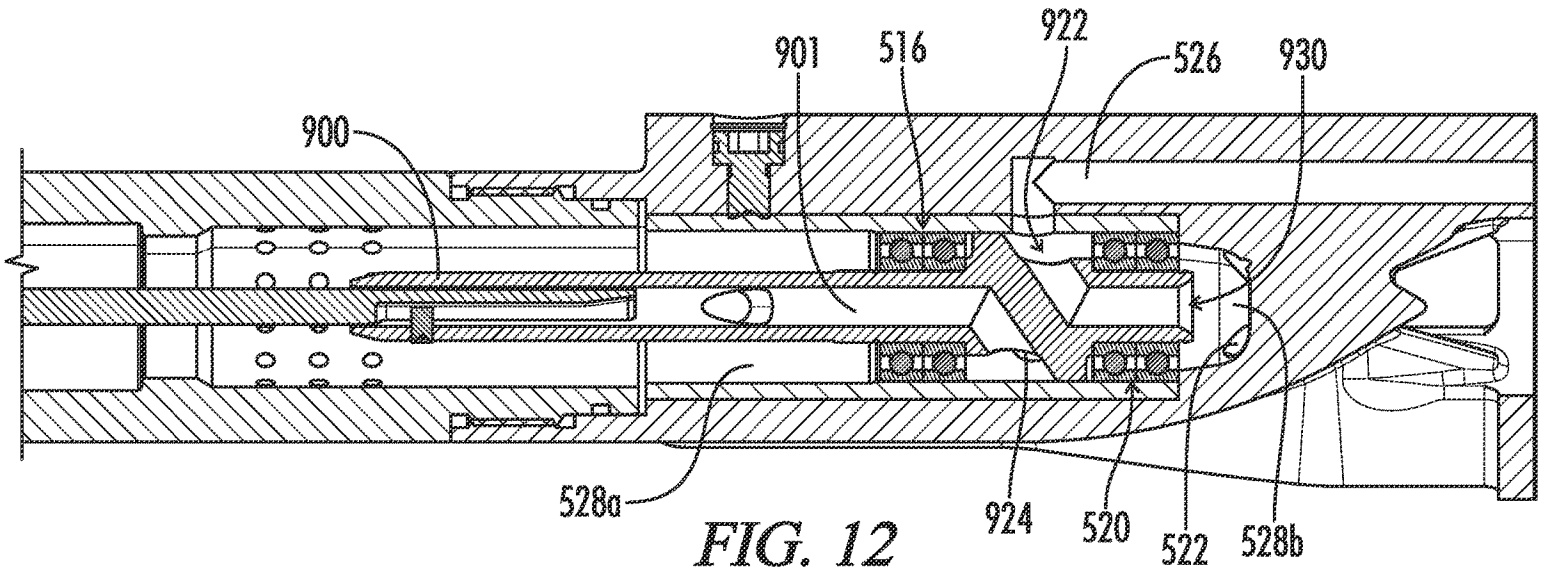
FIG. 12 is a cross sectional view of a fluid control valve of a tool control system incorporating a spool according to FIG. 9 in an alternate embodiment of the present invention with the spool positioned to de-energize a piston.

FIG. 12 shows the spool 900 in a second position which allows drilling fluid 126 to be discharged from the piston gallery 526 through second passage inlet 922, through the second passage of spool 900, and into downhole chamber portion 528*b*.

According to some embodiments in which the fluid control valve body 510 includes a plurality of piston galleries 526, spool 506 can be configured so that at certain angles of rotation first passage outlet 524 at least partially aligns with an opening of first piston gallery 526, while the second passage inlet 604 simultaneously at least partially overlaps with the opening of a second piston gallery 526 so that the actuation of one piston through the first piston gallery 526 overlaps at least in part with the discharge of another piston as drilling fluid simultaneously exits the piston through the second piston gallery 526. According to other embodiments in which the fluid control valve body 510 includes a plurality of piston galleries 526, spool 506 can be configured so that there are no angles of rotation at which first passage outlet 524 aligns with an opening of first piston gallery 526 while the second passage inlet 604 simultaneously even partially overlaps with the opening of a second piston gallery 526. In such embodiments, there is no rotational position of spool 506 where the actuation of one piston through the flow of drilling fluid into a first piston gallery 526 overlaps with the discharge of another piston as drilling fluid simultaneously exits the other piston through the second piston gallery 526.

The cross sectional area open to drilling fluid flow in each piston gallery 526 and first passage 524 along the flow path from the drilling fluid inlet port 530 into a piston being energized can also affect the ability of the tool control system 105 to actuate a connected device, such as a steering body 202. Additionally, the cross sectional area open to drilling fluid flow in each piston gallery 526, exhaust gallery 522, and second passage 602 along the flow path of drilling fluid 126 from a piston to the annulus as the piston exhausts drilling fluid 126 and de-energizes it can also affect the performance of the tool control system 105 in actuating a connected device, such as a steering body 202. Easier, more open flow of drilling fluid 126 along its flow path can allow the control system 105 to provide increased performance such as increased tool rotation rates (RPM), more dogleg, and the ability to handle larger volumes of lost circulation material when actuating a steering body. Other potential benefits can include reducing back pressure on pistons as they exhaust drilling fluid. Reducing back pressure can result in lower forces on the pistons and reduced piston wear. Accordingly, the drilling fluid's path from a piston, via a piston gallery 526, second passage 602, and inner chamber 528, through exhaust gallery 522 and any other galleries or passages that may be located between the exhaust gallery outlet port 402 till its exit to the annulus, preferably includes no small restrictions such as bleed nozzles. In this way, the drilling fluid can travel from the piston to the low-pressure zone of the annulus with a minimal pressure drop. To minimize pressure drop, the cross sectional area of the drilling fluid's flow path as it exits from a piston when it is de-energized should not be unduly restricted as compared to the flow path of the drilling fluid that enters the piston during activation. Accordingly, preferably the minimum flow cross sectional area, i.e., the minimum cross sectional area open to drilling fluid flow along either the length of the exhaust gallery 522 or along the length of the second passage 602 is greater than at least half of the minimum flow cross sectional area at any point along the length of the first passage 514. More preferably, the minimum cross sectional area open to drilling fluid flow along either the length of the exhaust gallery 522 or along the length of the second passage 602 is greater than at least 75 percent of the minimum flow cross sectional area at any point along the length of the first passage 514. Even more preferably, the minimum cross sectional area open to drilling fluid flow along either the length of the exhaust gallery 522 or along the length of the second passage 602 is about the same as or greater than the minimum flow cross sectional area at any point along the length of the first passage 514. Put another way, the minimum cross sectional area open to drilling fluid flow along either the length of the exhaust gallery 522 or along the length of the second passage 602 is unrestricted and is at least 95 percent of the minimum flow cross sectional area at any point along the length of the first passage 514. Yet more preferably, drilling fluid flow through exhaust gallery 522 should not be reduced by downstream restrictions in the drilling fluid flow path beyond exhaust port 402 that reduces the flow cross sectional area to 95 percent or less of the minimum flow cross sectional area of the first passage 514.

Figure 13:
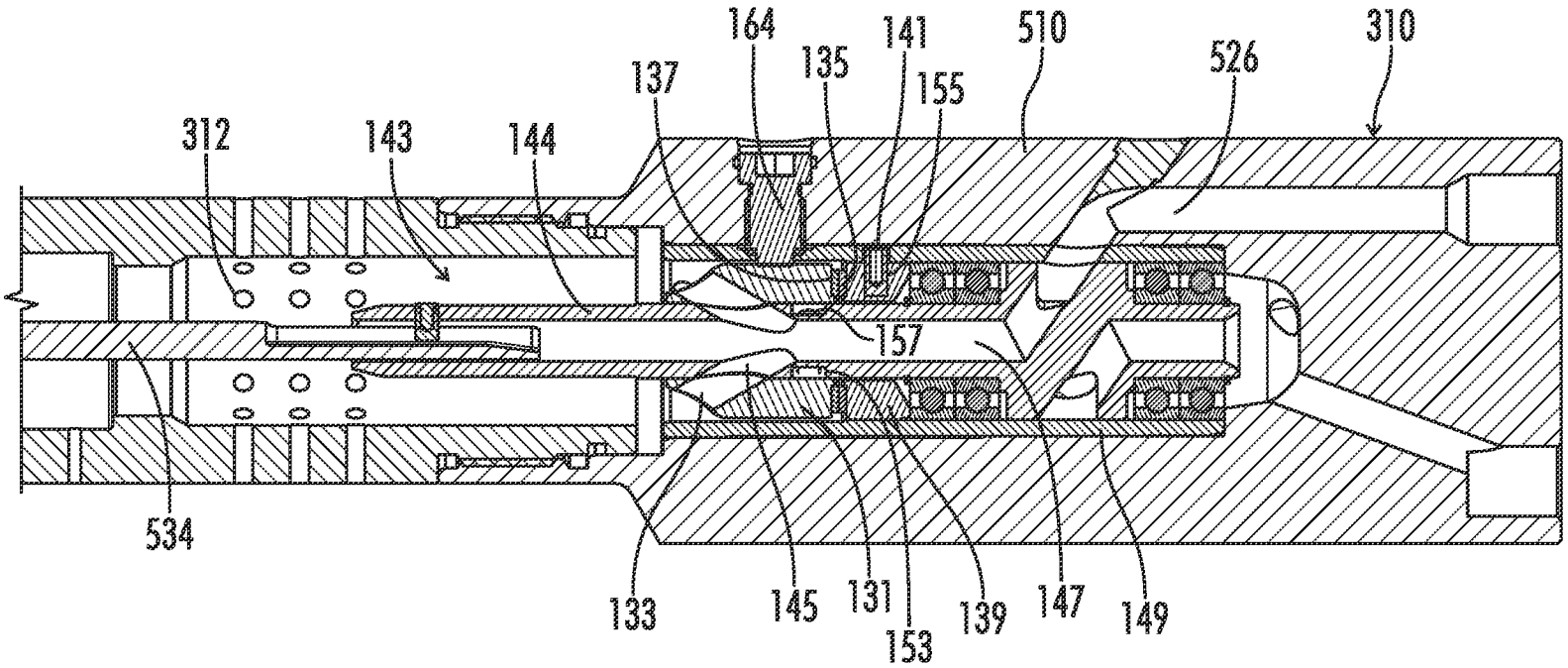
FIG. 13 is a cross sectional view of a fluid control valve of a tool control system with a spool positioned to energize a piston and incorporating a piston shut off assembly in an open position.
Figure 15:
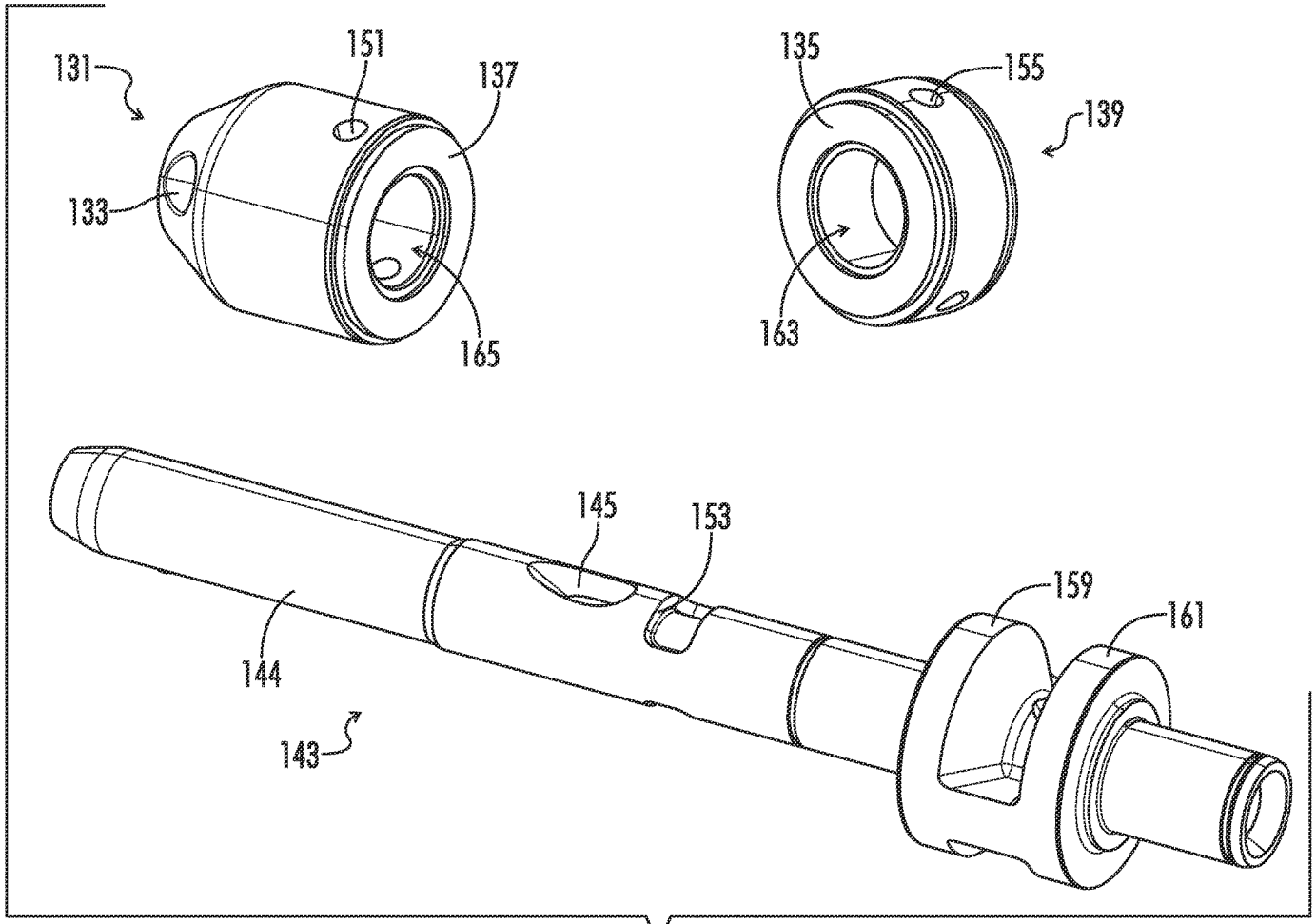
FIG. 15 is a perspective view of a shut off valve, friction plate, and friction disks of a shut off assembly and a spool according to a further embodiment.

Some embodiments can advantageously provide an improved shut off system in downhole tools controlled by fluid control valves, such as rotary steerable tools. These systems can controllably disable tool operation by shutting off the flow of drilling fluid to the spool and pistons of the rotary steerable tool spool or enable tool operation by opening the flow of drilling fluid to the spool and pistons when an operator wishes to steer the drill string using the tool. One such shut off system can include a piston shut off assembly made up of a piston shut off valve, a friction plate, and one or more friction plates that are rotatably mounted on the spool of a rotary steerable tool's fluid control valve. FIG. 13 shows a rotary steerable tool shut-off system in which a piston shut off assembly includes piston shut off valve 131, a friction plate 139 and, optionally, one or more first friction disks 137, and one or more second friction disks 135. As may be understood more clearly with reference to FIG. 15, the shut off valve 131 can, optionally, have a generally cylindrical, tubular cross section with a central bore 165 surrounded by the side wall of the shut off valve body. One or more holes in the side wall each form shut off valve ports 133 and extend from the outer surface of the shut off valve to the shut off valve bore 165 so as to permit the flow of drilling fluid to the bore 165. Friction plate 139 can also have a cylindrical, tubular cross section with a bore 163 surrounded by the side wall of the friction plate.

In some embodiments, when assembled as a shut off system in fluid control valve 310, shut off valve 131 and friction plate 135 are rotatably mounted on a spool shaft 144 which extends longitudinally from a transverse flange 159 of spool 143 through bore 163 of friction plate 139 and bore 165 of shut off valve 131. Friction plate 139 is preferably located closest to flange 159, while the shut off valve 131 is located further from flange 159, but still next to friction plate 139 so that the adjacent surfaces of friction plate 139 and shut off valve 131 directly contact one another or are separated by wear surfaces. Friction plate wear surface can be a friction disk 135 attached to the surface of friction plate 139 adjacent to shut off valve 131. Shut off valve wear surface can be friction disk 137 attached to the surface of the shut off valve 131 adjacent to friction plate 139.

In the embodiment shown in FIG. 13, spool shaft 144 is generally cylindrical and is located centrally and approximately coaxially with the central axis of inner chamber 528. Spool shaft 144 preferably has a generally tubular cross section with side walls that surround first passage 147. First passage 147 extends longitudinally within spool shaft 144 away from flange 159 into uphole chamber portion **528*a*. Flange 159 extends transversely from spool shaft across inner chamber to form a seal against the walls of inner chamber 528 or sleeve 149 which can optionally be provided to line the wall of inner chamber 528. One or more holes or openings in the sidewall of spool shaft 144 each forms a spool inlet port 145 to provide fluid communication between the surface of spool shaft 144 and first passage 147. Each spool inlet port 145 is preferably positioned to correspond with the positions of the shut off valve ports 133 when the shut off valve 131 is moved to a first, or open, position to provide fluid communication between uphole chamber portion 528*a* through the shut off valve bore and the surface of spool shaft 144 to first passage 147. Thus, in normal operation when the shut off valve is in this position, drilling fluid can flow from drilling fluid inlet port into the inner chamber and through spool inlet port 145 to first passage 147. When shut off valve 131 is moved to a second shut off position, there is no overlap between the shut off valve ports 133 and spool inlet ports 145. In this second shut off position, there is minimal or no drilling fluid flow—essentially no fluid communication—between the surface of the spool shaft and the uphole chamber portion 528*a* and the shut off valve effectively blocks the flow of drilling fluid into first passage 147**.

As in the embodiments of FIGS. 5 and 6 described above, spool 143 is preferably mounted in fluid control valve 310 on journals, bearings, or similar low friction supports so as to be free to rotate relative to inner chamber 528. Similar to FIG. 5, in FIG. 13 spool 143 is positioned so that drilling fluid entering first passage 147 can flow through into piston gallery 526 to energize a piston. Drive shaft 534 is coupled to spool shaft 144 to rotate the spool 143 relative to inner chamber 528 so that periodically spool 143 moves into a position where second passage 149 is aligned with piston gallery to permit drilling fluid to flow out and de-energize the rotary steerable tool pistons. Friction plate 139 is preferably rotationally fixed by, for example, a pin or set screw 141 that protrudes from sleeve 149 to engage a recess 155 in friction plate 139 and, thereby, hold friction plate 139 in place. Because friction plate 139 is rotationally fixed relative to inner chamber 528, friction plate 139 rotates relative to spool 143. As friction plate 139 rotates relative to spool 143, the engaged contacting surfaces of friction plate 139 and shut off valve 131, or of their respective friction disks 135, 137, slide relative to one another and generate friction which tends to drag shut off valve 131 to rotate in the same relative direction. In general, the relative rotation of friction plate 139 causes shut off valve 131 to rotate similarly when there is more drag force between friction plate 139 and shut off valve 131 engaged contacting surfaces than there is between the spool 143 and shut off valve 131. To achieve more drag force then friction plates with higher coefficients of friction can be used. The material used for the friction plates can be steel with ceramic coatings or synthetic materials, such as automotive brake pads or fibrous materials such as the material found in the clutches of automotive vehicles. The rotation of the shut off valve 131 can be dampened or retarded by the opposing friction of friction ring 164 in fluid control valve body 510 which can be adjusted to protrude into inner chamber 528 to impinge against an outer surface of shut off valve 131.

In normal drilling operation the drive shaft 534 generally rotates counter-clockwise relative to inner chamber 528. This is because the drill string and rotary steerable tool are rotated clockwise when looking downhole. Therefore, to maintain direction in which pistons 110 apply thrust against the borehole, spool 143 counter rotates, i.e., rotates counter-clockwise, at a rate generally equal and opposite to drill string's rotation to offset the rotation of the drill string. With this counter-clockwise rotation of drive shaft 534 and spool 143 relative to inner chamber 528, piston shut off valve 131 is dragged clockwise relative to spool 143. A protrusion or similar member 157 of shut off valve 131 that extends inwards into bore 165 engages with recess, slot, or similar member 153 in sidewall of spool shaft 144 to restrict and limit the rotation of shut off valve 131 relative to spool 143. Preferably slot 153 is larger than protrusion 157, so that protrusion 157 can move within slot 153 and accommodate a desirable range of relative rotational motion between spool 143 and shut off valve 131. For example, where shut off valve 131 and spool 143 both have two diametrically opposed ports a 90 degree range of rotational motion can be desirable. Accordingly, at the end of its clockwise rotation relative to spool 143, shut off valve is in an open position, as shown in FIG. 13, allowing drilling fluid to flow from drilling fluid inlet port 530 into piston gallery 526 and enable operation of rotary steerable tool steering.

Figure 14:
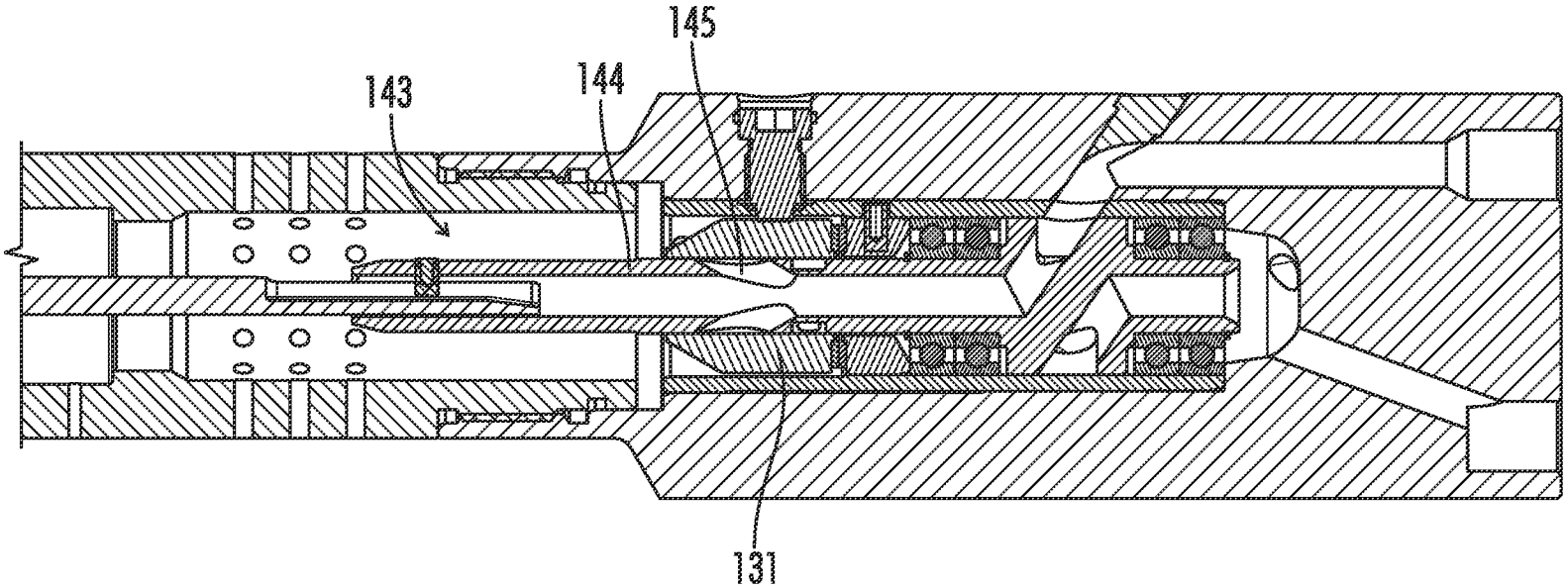
FIG. 14 is a cross sectional view of a fluid control valve of a tool control system with a spool positioned to energize a piston and incorporating a piston shut off assembly in an shut position.

To disable rotary steerable tool operation when no steering control is required, and to prevent the flow of drilling fluid to rotary steerable tool pistons 110, drive shaft 534 rotates in a clockwise direction relative to the inner chamber 528. Providing the rotational drag force between the friction plates 137 and 135 is greater the drag force between the shut off valve 131 and spool 143, shut off valve 131 rotates counter-clockwise relative to spool 143 into a second shut off position as shown in FIG. 14.

Thus, although there have been described particular embodiments of the present invention of a new and useful Fluid Control Valve for Rotary Steerable Tool it is not intended that such references be construed as limitations upon the scope of this invention except as set forth in the following claims.

What is claimed is:

1. A rotary steerable tool shut-off system comprising:

a fluid control valve body having an inner chamber with cylindrical side walls, a piston gallery extending between the inner chamber and a piston port, and an exhaust gallery extending between the inner chamber and an exhaust port, the inner chamber having a drilling fluid inlet port;

a spool in the inner chamber, the spool having a spool shaft extending longitudinally along a central axis of the inner chamber from a transverse flange, a first passage that extends longitudinally through at least a portion of the spool shaft, and at least one spool inlet port providing fluid communication between an outer surface of the spool shaft and the first passage, wherein the first passage can be in fluid communication with the drilling fluid inlet port but not the exhaust port, and a second passage in the spool that can be in fluid communication with the exhaust port but not the drilling fluid inlet port;

a piston shut off valve rotatably mounted on the spool shaft, wherein the piston shut off valve includes a shut off valve port which provides fluid communication between the inner chamber and the outer surface of the spool shaft;

wherein the piston shut off valve can rotate to a first position relative to the spool shaft such that the shut off valve port at least partially overlaps with the spool inlet port to provide fluid communication between the first passage and the drilling fluid inlet port, and wherein the piston shut off valve can rotate to a second position relative to the spool shaft such that the shut off valve port does not overlap with the spool inlet port and seals the first passage from fluid communication with the drilling fluid inlet port.

2. The system of claim 1, further comprising a friction plate rotatably mounted on the spool shaft and fixedly connected to the inner chamber, wherein the friction plate is slidably coupled to the piston shut off valve.

3. The system of claim 2, wherein a surface of the friction plate slidably engages a surface of the piston shut off valve.

4. The system of claim 2, further comprising at least one friction disk rotatably mounted on the spool shaft sandwiched between the friction plate and piston shut off valve, wherein at least one surface of the friction disk is slidably engaged with a surface of the piston shut off valve, the friction plate or a second friction disk.

5. The system of claim 1, wherein the spool shaft extends through a bore of the shut off valve and wherein a member of the spool shaft engages with a member of the shut off valve to restrict the rotation of the shut off valve relative to the spool shaft between the first position and the second position.

6. The system of claim 1, wherein the spool is movable to an actuation position in the inner chamber such that the first passage forms a fluid flow path between the piston gallery and the drilling inlet port, and also movable to a discharge position such that the second passage forms a fluid flow path between the piston gallery and the exhaust port.

7. The system of claim 1, wherein the exhaust gallery has a flow path that is unrestricted.

8. The system of claim 1, wherein the first passage has a length and a first passage minimum flow cross sectional area at some point along its length, wherein the second passage has a length and a second passage minimum flow cross sectional area at some point along its length, wherein the exhaust gallery has a length and an exhaust gallery minimum flow cross sectional area, and wherein both the exhaust gallery minimum flow cross sectional area and the second passage minimum flow cross sectional area are greater than at least half of the first passage minimum flow cross sectional area.

9. A method of controlling a rotary steerable tool shut off system, the method comprising:

providing a fluid control valve body having an inner chamber, a piston gallery extending between the inner chamber and a piston port, and an exhaust gallery extending between the inner chamber and an exhaust port, the inner chamber having a drilling fluid inlet port, providing a spool in the inner chamber, the spool having a spool shaft extending longitudinally along a central axis of the inner chamber from a transverse flange, a first passage that extends longitudinally through at least a portion of the spool shaft, and at least one spool inlet port providing fluid communication between an outer surface of the spool shaft and the first passage, wherein the first passage can be in fluid communication with the drilling fluid inlet port but not the exhaust port, and a second passage can be in fluid communication with the exhaust port but not the drilling fluid inlet port; and providing a piston shut off valve rotatably mounted on the spool shaft, wherein the piston shut off valve includes a shut off valve port which provides fluid communication between the inner chamber and the outer surface of the spool shaft.

10. The method of claim 9, further comprising rotating the piston shut off valve to a first position relative to the spool shaft such that the shut off valve port at least partially overlaps with the spool inlet port to provide fluid communication between the first passage and the drilling fluid inlet port.

11. The method of claim 9, further comprising rotating the piston shut off valve to a second position relative to the spool shaft such that the shut off valve port does not overlap with the spool inlet port and seals the first passage from fluid communication with the drilling fluid inlet port.

12. The method of claim 9, further comprising providing a friction plate rotatably mounted on the spool shaft and fixedly connected to the inner chamber, wherein the friction plate is slidably coupled to the piston shut off valve.

13. The method of claim 12, wherein a surface of the friction plate slidably engages a surface of the piston shut off valve.

14. The method of claim 12, further comprising providing at least one friction disk rotatably mounted on the spool shaft sandwiched between the friction plate and piston shut off valve, wherein at least one surface of the friction disk is slidably engaged with a surface of the piston shut off valve, the friction plate or a second friction disk.

15. The method claim 12, further comprising:

rotating the spool counter-clockwise relative to the inner chamber; and rotating the piston shut off valve to a first position relative to the spool shaft such that the shut off valve port at least partially overlaps with the spool inlet port to provide fluid communication between the first passage and the drilling fluid inlet port.

16. The method of claim 15, further comprising:

receiving fluid from the fluid inlet port into the first passage and discharging the fluid into the piston gallery, when the spool is in an actuation position; and receiving fluid from the piston gallery into the second passage and discharging the fluid into the exhaust gallery when the spool is in a discharge position.

17. The method of claim 15, further comprising:

rotating the spool clockwise relative to the inner chamber; and rotating the piston shut off valve to a second position relative to the spool shaft such that the spool inlet port does not overlap with the shut off valve port and seals the first passage from fluid communication with the drilling fluid inlet port.

* * * * *